US012252326B2

(12) United States Patent
Forsberg

(10) Patent No.: US 12,252,326 B2
(45) **Date of Patent: *Mar. 18, 2025**

(54) SYSTEM FOR TRANSPORTING HOT FOOD

(71) Applicant: Paul J. Forsberg, Naples, FL (US)

(72) Inventor: Paul J. Forsberg, Naples, FL (US)

( * ) Notice: Subject to any disclaimer, the term of this patent is extended or adjusted under 35 U.S.C. 154(b) by 140 days.

This patent is subject to a terminal disclaimer.

(21) Appl. No.: 18/179,754

(22) Filed: Mar. 7, 2023

(65) Prior Publication Data

US 2023/0249897 A1 Aug. 10, 2023

Related U.S. Application Data

(63) Continuation-in-part of application No. 17/857,798, filed on Jul. 5, 2022, now Pat. No. 11,952,182, which is a continuation-in-part of application No. 17/154,592, filed on Jan. 21, 2021, now abandoned.

(60) Provisional application No. 62/963,946, filed on Jan. 21, 2020.

(51) Int. Cl.
*B65D 81/38* (2006.01)
*B65D 85/36* (2006.01)

(52) U.S. Cl.
CPC ..... *B65D 81/3834* (2013.01); *B65D 85/36* (2013.01); *B65D 2203/00* (2013.01); *B65D 2585/366* (2013.01)

(58) Field of Classification Search
CPC .... B65D 2581/3472; B65D 2581/3494; B65D 2581/3447; B65D 2581/3498; B65D 25/14; B65D 5/4229; B65D 5/566; B65D 5/2052; B65D 5/4216; B65D 85/36; B65D 2585/366; A47G 21/001; B31B 2120/40; B31B 2120/407; B32B 2307/304; B32B 15/20; B32B 2307/724; B32B 2439/70
USPC ... 229/122.34, 906, 902, 103, 164.2, 103.11, 229/117.35, 117.29, 903, 730; 426/115, 426/124, 109; 206/524.3; 156/272.2; D9/456
See application file for complete search history.

(56) References Cited

U.S. PATENT DOCUMENTS

| | | | |
|---|---|---|---|
| 3,721,803 | A | 3/1973 | DiStefano |
| 4,237,171 | A | 12/1980 | Laage et al. |
| 4,922,626 | A | 5/1990 | Fiddler |
| 5,180,075 | A | 1/1993 | Montalbano |

(Continued)

FOREIGN PATENT DOCUMENTS

| | | | |
|---|---|---|---|
| CA | 2901121 | A1 | 2/2017 |
| DE | 4428948 | A1 | 2/1996 |
| WO | 2010119140 | A1 | 10/2010 |

*Primary Examiner* — Christopher R Demeree
(74) *Attorney, Agent, or Firm* — Mark Terry

(57) ABSTRACT

A system for addition to a box for transporting hot food includes a top sheet of paper having a length and a width equal to an interior of the box, such that the top sheet fits within the box without being folded, a bottom sheet of paper having a length and a width longer than the interior of the box, such that when the bottom sheet is placed within the interior of the box, edges of the bottom sheet are configured to extend upwards along sides of the interior of the box, a second fold defining a strip of paper above the top sheet, a food-safe laminate coating on an interior surface of the top and bottom sheets, wherein said coating has heat reflecting characteristics and oil-resistant characteristics, and orifices in the top sheet for allowing moisture to escape therethrough.

15 Claims, 8 Drawing Sheets

(56) References Cited

U.S. PATENT DOCUMENTS

| | | | | |
|---|---|---|---|---|
| 5,423,477 | A | 6/1995 | Valdman et al. | |
| 5,445,286 | A * | 8/1995 | Guimarin | B65D 81/18 229/117.34 |
| 5,662,237 | A | 9/1997 | Cain | |
| 6,019,511 | A | 2/2000 | Thomas et al. | |
| 6,652,933 | B2 | 11/2003 | Hall | |
| 6,827,218 | B1 | 12/2004 | Dick et al. | |
| 6,932,267 | B2 | 8/2005 | Potenza, Jr. et al. | |
| 7,051,919 | B1 * | 5/2006 | Walsh | B65D 5/5475 229/103 |
| 7,380,702 | B2 * | 6/2008 | Oddo | B65D 77/245 229/122.34 |
| 7,387,231 | B2 * | 6/2008 | Yandian | B65D 5/5035 229/122.34 |
| 8,662,378 | B2 * | 3/2014 | Mehta | B65D 65/403 493/344 |
| 9,162,808 | B2 * | 10/2015 | Chebli | B65D 81/264 |
| 9,994,354 | B2 * | 6/2018 | Volpis | B65D 85/36 |
| 11,066,207 | B2 * | 7/2021 | Cavaceppi | B65D 5/5028 |
| 11,225,364 | B2 * | 1/2022 | Goldberg | A47J 43/288 |
| 2002/0079357 | A1 * | 6/2002 | Tulkoff | B65D 85/36 229/199 |
| 2004/0094436 | A1 | 5/2004 | Potenza et al. | |
| 2005/0184141 | A1 | 8/2005 | Alexander et al. | |
| 2006/0172059 | A1 | 8/2006 | Takeuchi | |
| 2010/0072197 | A1 * | 3/2010 | Neff | B65D 81/3453 219/730 |
| 2014/0299657 | A1 * | 10/2014 | Giudilli | B65D 5/603 493/63 |
| 2015/0150286 | A1 | 6/2015 | Milligan et al. | |
| 2015/0329265 | A1 | 11/2015 | Birgen et al. | |
| 2017/0202401 | A1 | 7/2017 | Mortell | |

* cited by examiner

PRIOR ART

SYSTEM FOR TRANSPORTING HOT FOOD

CROSS-REFERENCE TO RELATED APPLICATIONS

This patent application is a continuation in part of patent application Ser. No. 17/857,798 filed Jul. 5, 2022, and titled System for Transporting Hot Food, which is a continuation in part of patent application Ser. No. 17/154,592 filed Jan. 21, 2021, and titled System for Transporting Hot Food, which claims the benefit of provisional patent application No. 62/963,946 filed Jan. 21, 2020, and titled System for Transporting Hot Food. The subject matter of patent application Ser. Nos. 17/857,798, 17/154,592 and 62/963,946 are hereby incorporated by reference in their entirety.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The disclosed embodiments relate to the field of food containers, and more specifically to the field of boxes to transport hot foods from a source location to a predefined destination.

BACKGROUND

Containers to deliver freshly baked pizzas have existed at least since the 19th century, when Neapolitan pizza bakers put their products in multi-layered metallic containers and then sent them to the street sellers. The aerated container was round and made of tin or copper. Disposable packaging started to be developed in the United States, after the Second World War. At that time pizza was becoming increasingly popular and the first pizza delivery services were created. In the beginning they attempted to deliver pizzas in simple cardboard boxes, similar to those used in cake shops, but these often became wet, bent, or even broke in two. Other pizza chefs tried to put pizzas on plates and transport them inside paper bags. This partly solved the problem. However, it was almost impossible to transport more than a single pizza inside one bag. The first patent for a pizza box made of corrugated cardboard was applied in 1963 and displayed the characteristics of today's pizza packaging: plane blanks, foldability without need of adhesive, stackability and ventilation slots.

Nearly 60 years later, the pizza box design has not evolved much beyond the standard cardboard square. In fact, the pizza box remains a balancing act in proportions, which endeavors to retain just the right amount of heat to keep its contents warm and release the right amount of steam. On the one hand, if the pizza is completely sealed inside the pizza box, the steam released from the pizza will condense and create a soggy crust. On the other hand, if the pizza box has too much ventilation, the pizza will cool. Unfortunately, because the requirements between usability and functionality are often conflicting in nature, it is difficult to find a pizza box encompassing the above-mentioned elements without compromise. As a result, there exists a need for improvements over the prior art and more particularly, for a box that maintains its food contents fresh, crisp, and hot for an extended period of time.

SUMMARY

A system for addition to a box for transporting hot food is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a system for addition to a box for transporting hot food is disclosed. The system includes a top sheet of paper having a length and a width equal to a length and a width of an interior of the box, such that the top sheet fits within the interior of the box without being folded, a bottom sheet of paper having a length and a width that are both at least half an inch longer than the length and the width of the interior of the box, such that when the bottom sheet is placed within the interior of the box, edges of the bottom sheet are configured to extend upwards along sides of the interior of the box, a first food-safe laminate coating of food grade non-stick coated blend on an interior surface of the top sheet, wherein said first coating has heat reflecting characteristics, a second food-safe laminate coating on an interior surface of the bottom sheet, wherein said second coating has oil-resistant characteristics, as well has heat reflecting characteristics a plurality of orifices in the top sheet, the plurality of orifices configured for allowing moisture to escape therethrough, and, wherein the sheet is configured for being removably positioned within the interior of the box, such that the food rests on the interior surface of the bottom sheet.

In another embodiment, a system for transporting hot food includes a box, and a top sheet of paper having a length and a width equal to a length and a width of an interior of the box, such that the top sheet fits within the interior of the box without being folded, a bottom sheet of paper having a length and a width that are both at least half an inch longer than the length and the width of the interior of the box, such that when the bottom sheet is placed within the interior of the box, edges of the bottom sheet are configured to extend upwards along sides of the interior of the box, a first food-safe laminate coating on an interior surface of the top sheet, wherein said first coating has heat reflecting characteristics, a second food-safe laminate coating on an interior surface of the bottom sheet, wherein said second coating has oil-resistant characteristics, a plurality of orifices in the top sheet, the plurality of orifices configured for allowing moisture to escape therethrough, and, wherein the sheet is configured for being removably positioned within the interior of the box, such that the food rests on the interior surface of the bottom sheet.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate the claimed embodiments and together with the description, serve to explain the principles of the disclosed embodiments. The embodiments illustrated herein are presently preferred, it being understood, however, that the claimed embodiments are not limited to the precise arrangements and instrumentalities shown, wherein:

DETAILED DESCRIPTION

Figure 1:
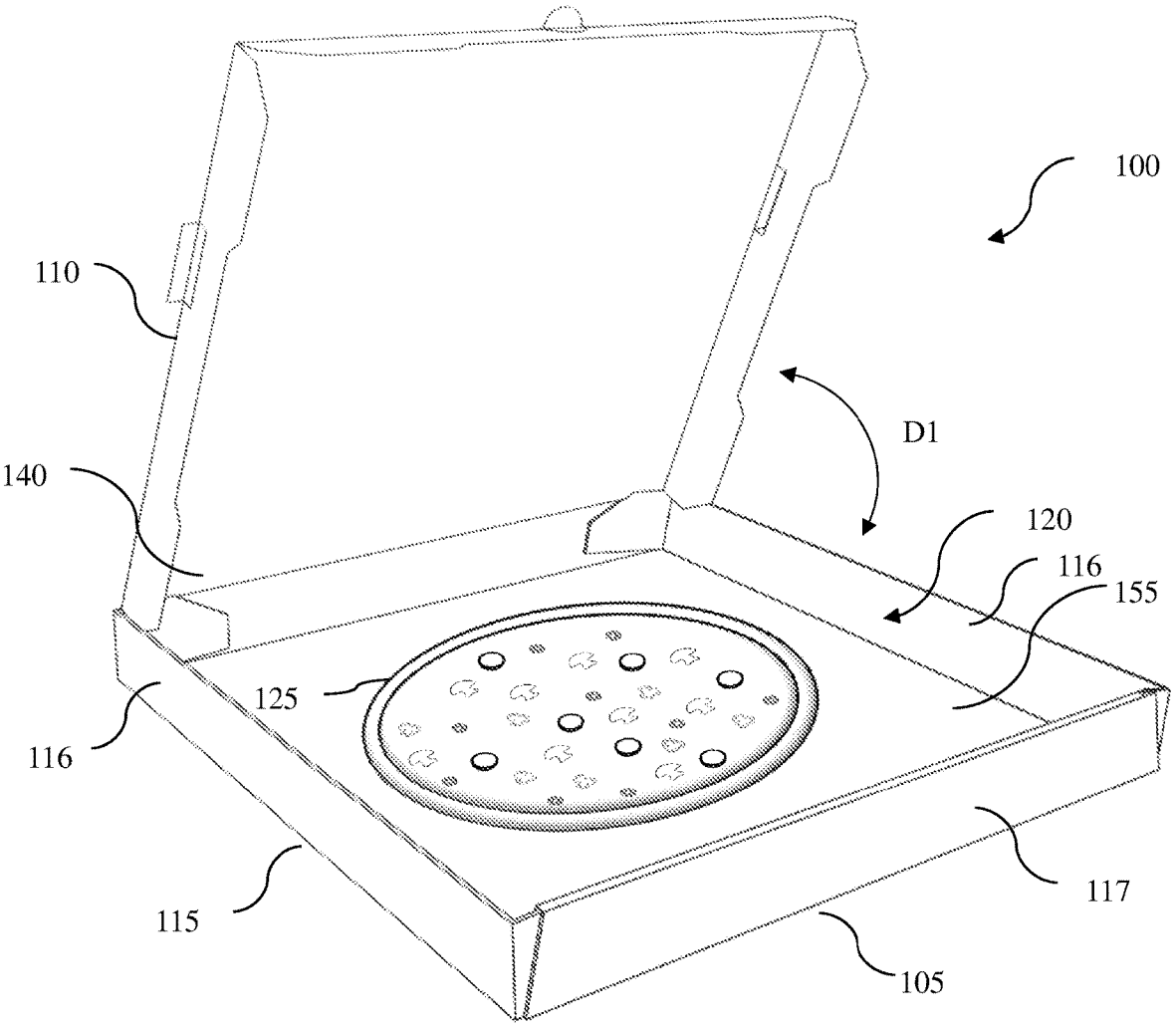
FIG. 1 is a front perspective view of a prior art system for transporting hot food.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The claimed embodiments improve upon the prior art by providing a system for transporting hot food that maintains its contents fresh, crisp, and hot for an extended period of time. Although the examples given below describe a system for transporting hot food relative to a pizza, those of skill in the art will appreciate that the claimed embodiments may be adapted for use with other foods, including, but not limited to burritos, burgers, French fries, and nachos.

Referring now to the Figures, FIG. 1 illustrates a prior art system 100 for transporting hot food according to an example embodiment. The system includes a box 105 having a top side 110 and a bottom side 115. The top side 110 of the box defines a first substantially planar surface and the bottom side 115 of the box defines a second substantially planar surface. The bottom side 115 of the box is hingedly attached to the box such that the top side 110 of the box may pivot between an open position and a closed position (in the direction of double arrowed line D1) to allow access to an interior volume 120 of the box 105. The interior volume 120 of the box 105 is formed by two opposing sidewalls 116 and two opposing end walls 117 on the bottom side of the box. The interior volume 120 of the box is configured to provide sufficient area to store at least one food item.

In the present embodiment, the box 105 is generally sized to store a pizza 125, however, it should be appreciated that the box may have other shapes and dimensions to accommodate additional foods, and such variations are within the spirit and scope of the claimed embodiments. The box is preferably comprised from an integral piece of recyclable, non-toxic and food safe paper-based material such as corrugated cardboard or may be similarly comprised of biodegradable or compostable materials such as sugarcane, bamboo, and plant-based materials. The pizza sits on an interior surface 155 of the bottom side 115 of the box 105 and the interior surface 140 of the top side 110 of the box 105 closes onto and on top of the pizza when the box is in the closed position.

Figure 2A:
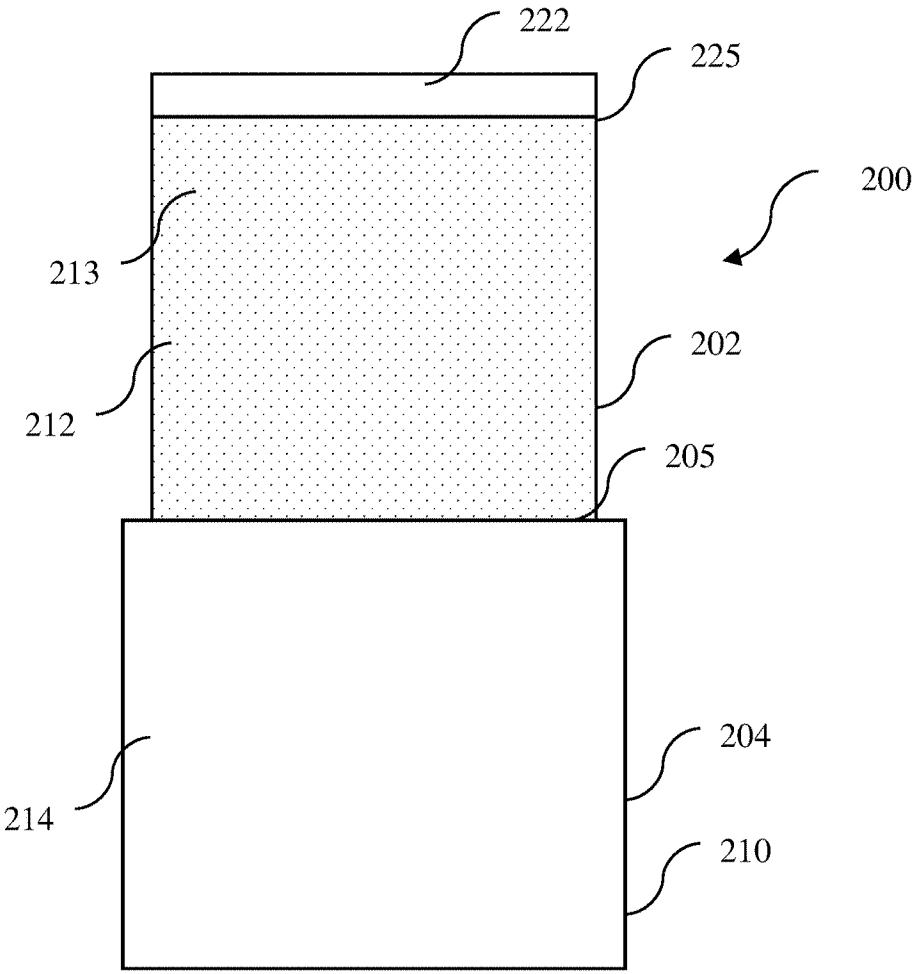
FIG. 2A is a front view of a first embodiment of a system for addition to a box for transporting hot food, shown in a flat orientation, according to an example embodiment.

FIG. 2A is a front view of a first embodiment of an insertable paper system 200 for addition to a box 105 for transporting food, the system comprising a sheet of paper 210 having a single fold 205 at or near a midpoint of the sheet, the single fold defining a top sheet 202 and a bottom sheet 204. The top sheet having a length and a width equal to a length and a width of an interior of the box 105 (such as 18 inches by 18 inches), such that the top sheet 202 fits within the interior of the box without being folded. The bottom sheet 204 having a length and a width that are both at least half an inch longer than the length and the width of the interior of the box 105 (such as 18.5 inches by 18.5 inches), such that when the bottom sheet is placed within the interior of the box, edges of the bottom sheet are configured to extend upwards along sides of the interior of the box. Notice that the length and the width of the bottom sheet are longer than the length and the width of the top sheet.

A first food-safe laminate coating of is deposited on an interior surface 212 of the top sheet 202, wherein said first coating has heat reflecting characteristics. A second food-safe laminate coating is deposited on an interior surface 214 of the bottom sheet 204, wherein said second coating has oil-resistant characteristics. A plurality of orifices 213 are located in the top sheet, the plurality of orifices configured for allowing moisture to escape therethrough. In one embodiment, the plurality of orifices 213 may be slits, holes, perforations, cuts, cutouts, of the like. The insertable paper system 200 is configured for being removably positioned within the interior of the box 105, such that the food rests on the interior surface 214 of the bottom sheet 204. The system is configured to allow steam and moisture to escape to prevent the food or pizza crust from getting soggy.

The food-safe laminate coatings are comprised of impermeable, nonstick material capable of resisting high temperatures, however, it should be appreciated that other impermeable, nonstick materials may be employed provided that they effectively prevent the top of the pizza from adhering to the system 200. It should be appreciated that attachment devices may be used to secure the system 200 to the interior surface 140 of the top side 110 of the box 105, including backing materials coated with natural adhesives made from organic sources such as vegetable starch, natural resins, or animals, clamps, brackets, slots, or any other suitable method known in the art. Note also that the insertable paper system 200 may be removably coupled to an interior surface 155 of the bottom side 115 of the box 105, according to an example embodiment.

The insertable paper system 200 is configured to maintain the freshly prepared pizza 125 warm during transportation. In operation, the system 200 is positioned inside the box 105 such that when the hot pizza is removed from the oven and placed directly on the box, the pizza 125 is elevated off the interior surface of the bottom side of the box by the width of system 200.

FIG. 2A also shows another fold 225 at a top of the top sheet 202, the fold 225 defining a strip 222, which acts as a handle or tab that may be handled by a person wanting to move the device 200. The fold 225 and fold 205 may be a perforated fold. The strip may have the same width as the top sheet but have a height (such as ½ to 1 inch) that is much smaller than the top sheet, hence referring to 222 as a strip. The strip may not include the orifices located in the top sheet.

Figure 2B:
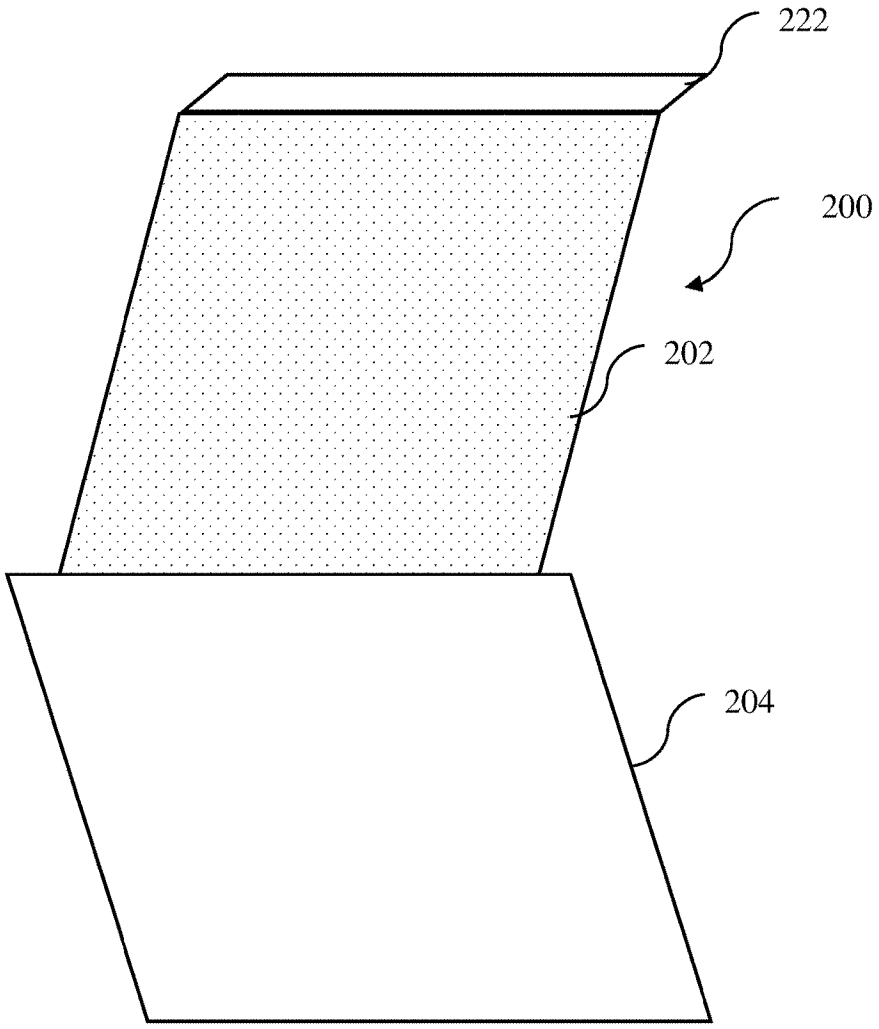
FIG. 2B is a front perspective view of the first embodiment of a system for addition to a box for transporting hot food, shown in a partially folded orientation, according to an example embodiment.

FIG. 2B is a front perspective view of the first embodiment of the insertable paper system 200 for addition to a box for transporting hot food, shown in a partially folded orientation, according to an example embodiment.

Figure 2C:
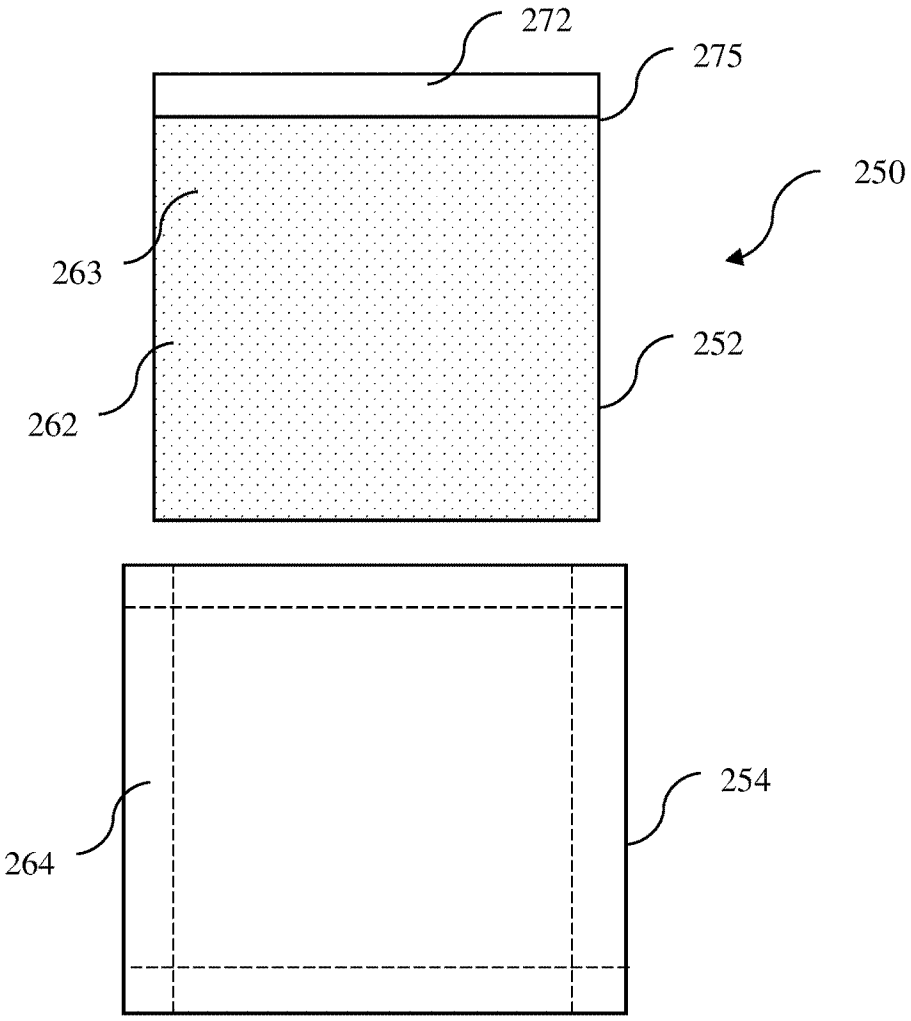
FIG. 2C is a front view of a second embodiment of a system for addition to a box for transporting hot food, shown in a flat orientation, according to an example embodiment.
Figure 2D:
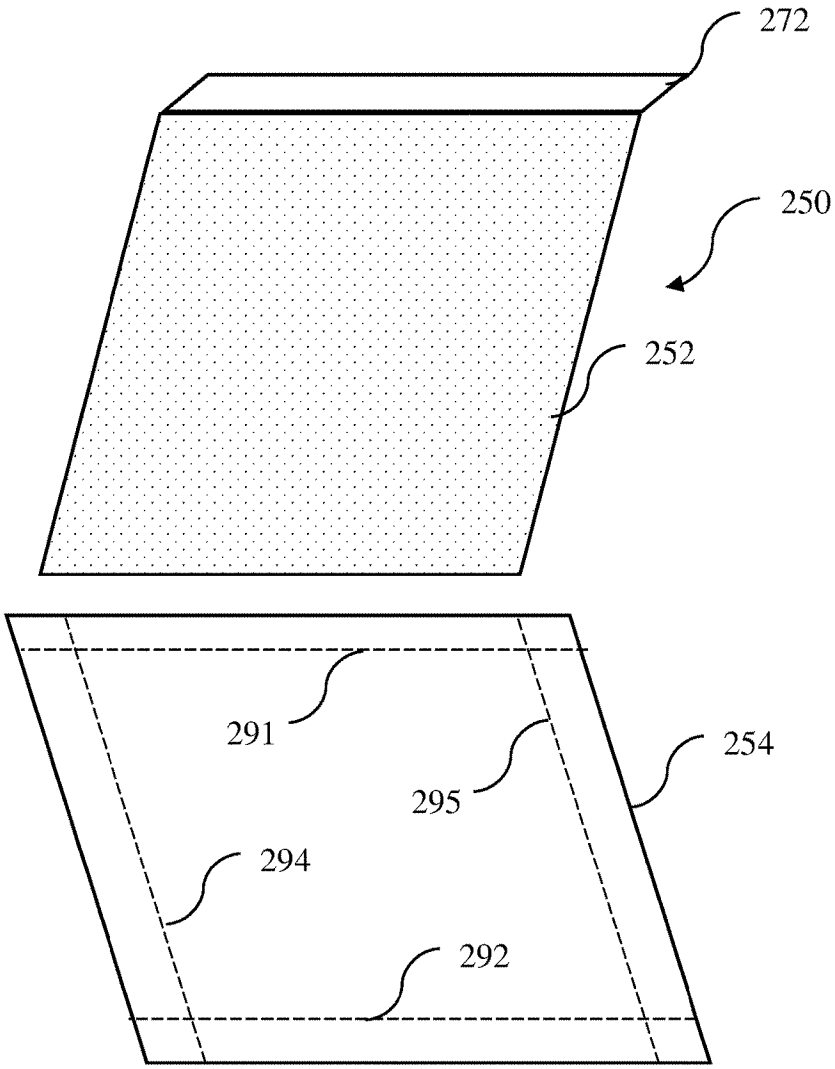
FIG. 2D is a front perspective view of the second embodiment of a system for addition to a box for transporting hot food, shown in a partially folded orientation, according to an example embodiment.

FIG. 2C is a front view of a second embodiment of an insertable paper system 250 for addition to a box 105 for transporting food, the system comprising two separate sheets of paper 252, 254. Whereas the embodiment of FIGS. 2A-2B show one single sheet, the embodiment of FIGS. 2C-2D show a set comprising two separate sheets—a top sheet and a bottom sheet. The top sheet having a length and a width equal to a length and a width of an interior of the box 105 (such as 18 inches by 18 inches), such that the top sheet 252 fits within the interior of the box without being folded. The bottom sheet 254 having a length and a width that are both at least half an inch longer than the length and the width of the interior of the box 105 (such as 18.5 inches by 18.5 inches), such that when the bottom sheet is placed within the interior of the box, edges of the bottom sheet are configured to extend upwards along sides of the interior of the box. Notice that the length and the width of the bottom sheet are longer than the length and the width of the top sheet.

A first food-safe laminate coating of is deposited on an interior surface 262 of the top sheet 252, wherein said first coating has heat reflecting characteristics. A second food-safe laminate coating is deposited on an interior surface 264 of the bottom sheet 254, wherein said second coating has oil-resistant characteristics. A plurality of orifices 263 are located in the top sheet, the plurality of orifices configured for allowing moisture to escape therethrough. The insertable paper system 250 is configured for being removably positioned within the interior of the box 105, such that the food rests on the interior surface 264 of the bottom sheet 254. The system is configured to allow steam and moisture to escape to prevent the food or pizza crust from getting soggy.

The food-safe laminate coatings are comprised of impermeable, nonstick material capable of resisting high temperatures, however, it should be appreciated that other impermeable, nonstick materials may be employed provided that they effectively prevent the top of the pizza from adhering to the system 250. It should be appreciated that attachment devices may be used to secure the system 250 to the interior surface 140 of the top side 110 of the box 105, including backing materials coated with natural adhesives made from organic sources such as vegetable starch, natural resins, or animals, clamps, brackets, slots, or any other suitable method known in the art. Note also that the insertable paper system 250 may be removably coupled to an interior surface 155 of the bottom side 115 of the box 105, according to an example embodiment.

The insertable paper system 250 is configured to maintain the freshly prepared pizza 125 warm during transportation. In operation, the system 250 is positioned inside the box 105 such that when the hot pizza is removed from the oven and placed directly on the box, the pizza 125 is elevated off the interior surface of the bottom side of the box by the width of system 250.

FIG. 2C also shows an optional fold 275 at a top of the top sheet 252, the fold 275 defining a strip 272, which acts as a handle or tab that may be handled by a person wanting to move the device 250. The fold 275 may be a perforated fold. The strip may have the same width as the top sheet but have a height (such as ½ to 1 inch) that is much smaller than the top sheet, hence referring to 272 as a strip. The strip may not include the orifices located in the top sheet.

Figure 3:
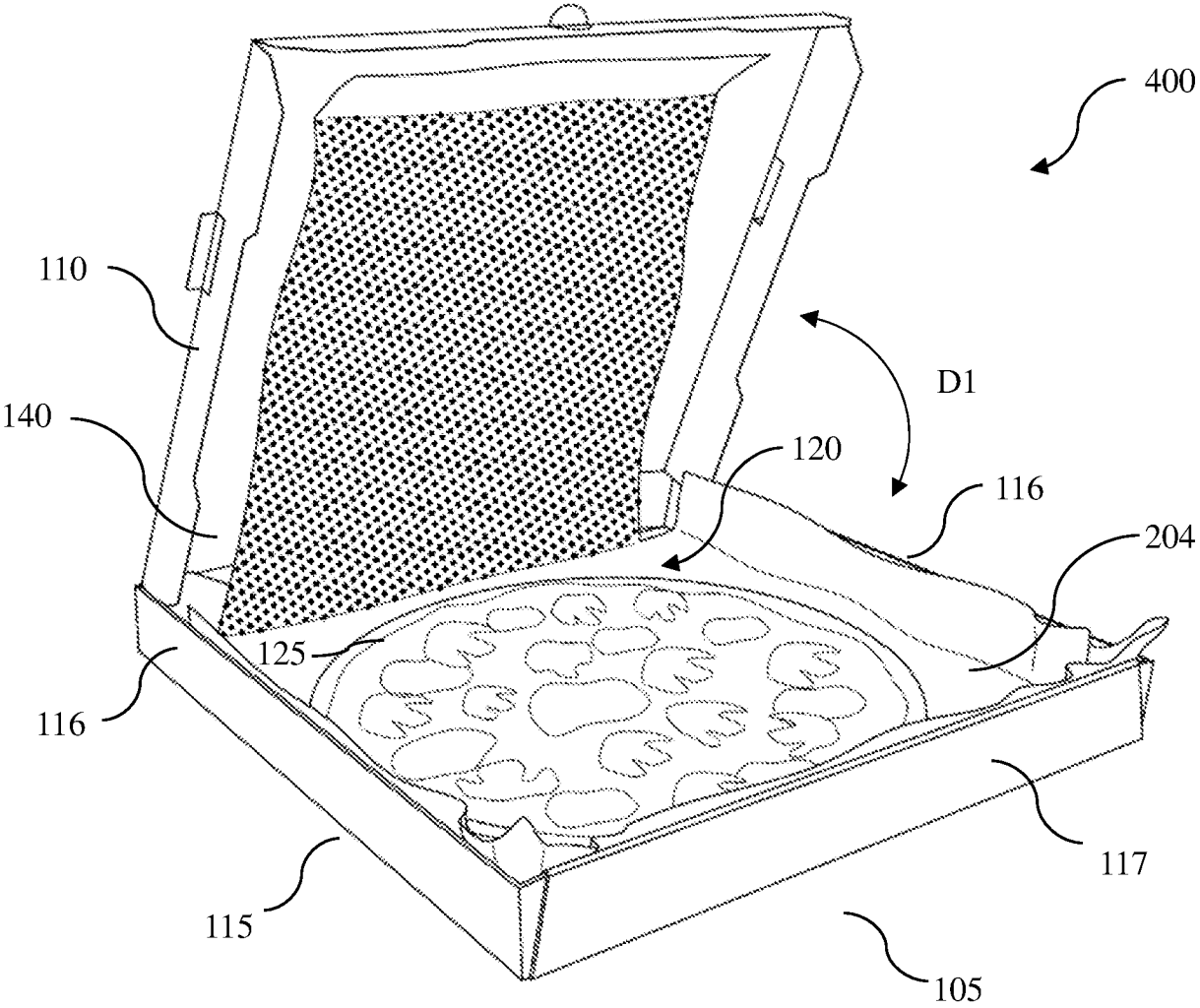
FIG. 3 is a front perspective view of the first embodiment of a system for transporting hot food, including a box and an insertable paper system, according to an example embodiment.
Figure 4:
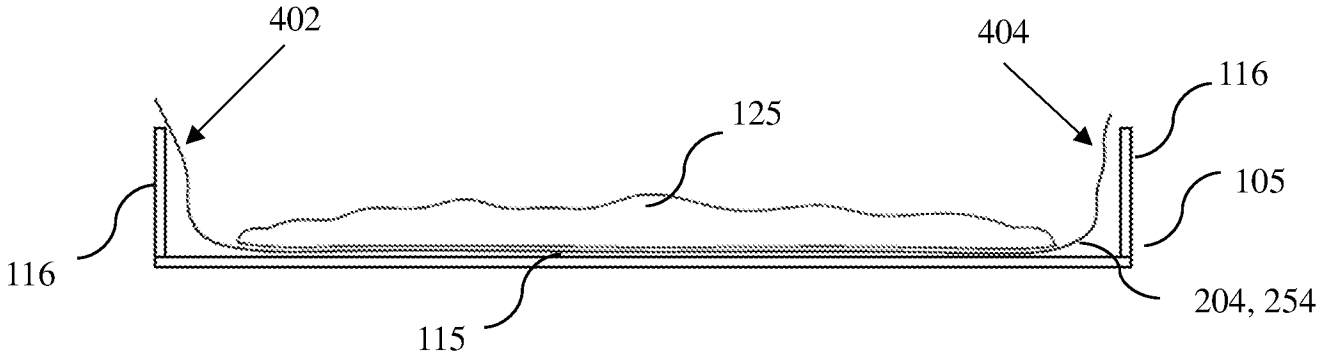
FIG. 4 is a cross sectional view of both embodiments of the system for transporting hot food, including a box and an insertable paper system, according to an example embodiment.

FIG. 2D is a front perspective view of the second embodiment of the insertable paper system 250 for addition to a box for transporting hot food, shown in a partially folded orientation, according to an example embodiment. FIG. 2D shows an embodiment wherein the bottom sheet 254 includes a plurality of perforations, scoring or pre-folded elements along the sides of the bottom sheet. Scoring 291 is a straight line that runs parallel to the top side of the bottom sheet while scoring 292 is a straight line that runs parallel to the bottom side of bottom sheet. Scoring 294 is a straight line that runs parallel to the left side of the bottom sheet while scoring 295 is a straight line that runs parallel to the right side of bottom sheet. The purpose of the plurality of perforations, scoring or pre-folded elements along the sides of the bottom sheet is to allow for the easy folding or turning of the bottom sheet when it is placed in the interior surface 155 of the bottom side 115 of the box 105, according to an example embodiment (as shown in FIGS. 3-4 below). Scoring refers to the process of making a crease in paper so it will fold easier. A score is a ridge that is indented into the paper where the fold line will occur. This indention is made such that it compresses the paper fibers to create a hinge-like area. This "hinge" is what allows for smoother folding. Scoring also helps improve the appearance of the fold because it provides a consistent guideline as well as reduces the potential for the paper to buckle or crack. In addition, scored paper is less likely to cause harm to toner-type inks or thicker clear coats during the folding operation.

FIG. 3 is a front perspective view of a system 400 for transporting hot food, including a box 105 and an insertable paper system 200, according to the first embodiment shown in FIGS. 2A, 2B. The system 400 includes the box 105 of FIG. 1 having a top side 110 and a bottom side 115. The top side 110 of the box defines a first substantially planar surface and the bottom side 115 of the box defines a second substantially planar surface. The bottom side 115 of the box is hingedly attached to the box such that the top side 110 of the box may pivot between an open position and a closed position (in the direction of double arrowed line D1) to allow access to an interior volume 120 of the box 105. The interior volume 120 of the box 105 is formed by two opposing sidewalls 116 and two opposing end walls 117 on the bottom side of the box. The interior volume 120 of the box is configured to provide sufficient area to store at least one food item.

The pizza 125 sits on top of the interior surface 214 of the bottom sheet 204, wherein said bottom sheet has a second coating that has oil-resistant characteristics. A plurality of orifices 213 are located in the top sheet, the plurality of orifices configured for allowing moisture from the pizza to escape therethrough. In one embodiment, the plurality of orifices 213 may be slits, holes, perforations, cuts, cutouts, of the like. The insertable paper system 200 is configured for being removably positioned within the interior of the box 105, such that the pizza rests on the interior surface 214 of the bottom sheet 204. The system is configured to allow steam and moisture to escape to prevent the food or pizza crust from getting soggy.

FIG. 3 shows that the bottom sheet 204 has a length and a width that are both longer (at least half an inch longer) than the length and the width of the interior surface 155 of the bottom side 115 of the box 105, such that when the bottom sheet is placed within the interior of the box, edges of the bottom sheet are configured to extend upwards along sides of the interior of the box. FIG. 3 show that the edges of the bottom sheet 204 travel upwards along the two opposing sidewalls 116 and two opposing end walls 117 on the bottom side of the box. FIG. 3 show that the edges of the bottom sheet 204 travel upwards around the entire perimeter of the box, so as to create a bowl-like shape that is able to hold liquid such as grease, oil, and the like. This prevents the pizza oil from touching or soaking the box, which allows the box to be recycled, since pizza boxes soiled with oil are not recyclable. The embodiment shown in FIG. 3 can also be used with the second embodiment 250 of the system for transporting hot food, as shown in FIGS. 2C, 2D.

In one embodiment, the bottom sheet 254 includes a plurality of perforations, scoring or pre-folded elements along the sides of the bottom sheet. Scoring 291, 292, 294, 295 (see FIG. 2D) comprise a plurality of perforations, scoring or pre-folded elements along the sides of the bottom sheet is to allow for the easy folding or turning of the bottom sheet when it is placed in the interior surface 155 of the bottom side 115 of the box 105, as shown in FIG. 3. That is, when the bottom sheet is placed within the interior of the box, the bottom sheet folds at the plurality of perforations, scoring or pre-folded elements, such that the edges 402, 404 of the bottom sheet extend upwards along sides of the interior of the box.

FIG. 4 is a cross sectional view of both embodiments of the system 400 for transporting hot food, including a box and an insertable paper system, according to an example embodiment. FIG. 4 shows that the bottom sheet 204 or 254 has a length and a width that are both longer (at least half an inch longer) than the length and the width of the interior surface 155 of the bottom side 115 of the box 105, such that when the bottom sheet is placed within the interior of the box, edges 402, 404 of the bottom sheet are configured to extend upwards along sides of the interior of the box. FIG. 4 show that the edges 402, 404 of the bottom sheet travel upwards along the two opposing sidewalls 116 on the bottom side of the box 105. FIG. 4 show that the edges of the bottom sheet 204, 254 travel upwards around the entire perimeter of the box, so as to create a bowl-like shape that is able to hold liquid such as grease, oil, and the like.

In one embodiment, the bottom sheet 254 includes a plurality of perforations, scoring or pre-folded elements along the sides of the bottom sheet that allow for the easy folding or turning of the bottom sheet when it is placed in the interior surface 155 of the bottom side 115 of the box 105, as shown in FIG. 4. That is, when the bottom sheet is placed within the interior of the box, the bottom sheet folds at the plurality of perforations, scoring or pre-folded elements, such that the edges 402, 404 of the bottom sheet extend upwards along sides of the interior of the box.

Figure 5:
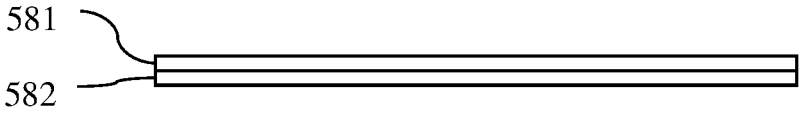
FIG. 5 is a cross sectional view of both embodiments of the insertable paper system, according to an example embodiment.

FIG. 5 is a cross sectional view of both embodiments the insertable paper system 200, 250, according to an example embodiment. The sheet(s) of the system 200, 250 may be composed of a first layer 582 of paper, wherein the first layer is configured for being removably coupled to an interior surface of the box. In one embodiment, the sheet of the system 200, 250 is not coupled to an interior surface of the box but rather simply lie(s) on top of, or under, the food in the box, set in place using solely gravity and friction. The second layer 581 may include printed material configured for advertising.

The first layer may be composed of paper, such as cotton paper, synthetic paper, parchment paper, baking paper, liners or bakery release paper is cellulose-based paper that has been treated or coated to make it non-stick. Said paper may have a certain pliability and have a reflectivity coating to reflect heat. Alternative to parchment paper is wax paper, which is paper that has been made moisture-proof through the application of wax. Alternative to parchment paper is acetate paper, which is a transparent material that is made by reacting cellulose with acetic acid in the presence of sulfuric acid. The first layer may be food and liquid impermeable, such that food and liquid from food (such as oil and water) does not pass through said first layer.

By utilizing vented holes or orifices for escaping moisture, the claimed embodiments address the issues associated with transporting pizzas and food items safely—heat loss, excessive moisture, and damage to the box from oil. The claimed embodiments allow heat to be redirected back into the food, and not out through the box edges. The venting orifices or holes are designed to allow moisture to escape away from the food and be absorbed into the insulated top sheet. The bottom sheet may not be vented, keeping the crust of a pizza, for example, hot and crispy by locking in the heat from escaping through the cardboard of the box and blocking oils or sauces from entering into the cardboard of the box, which preserves the box for recycling.

Tests performed used the claimed embodiments show that food can be kept at least at the recommended standard of 140 degrees for extended periods of time, using the claimed box system. Tests performed used the claimed embodiments show that food can also be kept at a 10-12-degree higher temperature of 152-154 for extended periods of time. Systems that do not use the claimed embodiment result in food temperatures well below the 140-degree mark (from 95 to 120 degrees), inviting food borne bacterial growth.

Paper with vented holes or orifices for escaping moisture allows moisture to exit. Without these vented holes, condensation cannot exit freely enough. Without these vented holes, the adhesion effect applies, and droplets of rain develop and falls back into the food in the box. Venting must occur equally and evenly related to the top insert. The vented holes may be standard holes, perforated holes, slits, round holes, square holes, and the like.

The present invention provides outstanding results achieving 30 minutes of travel time keeping pizza hot, safe, well above temperatures that eliminates bacterial growth. The present invention is a laminated coated sheet with a plurality of small slits or pinholes that allows moisture to escape while simultaneously reflecting heat back into the pizza. The bottom portion is a solid coated sheet that effectively blocks oils and aligns the pizza perfectly in place. The size and shape of the present invention may be oversized by ¼"-¾"+ to create an oil containment edge within the bottom insert. The built-in edge trap holds spillages of cheesy residue and oils on the inside edges of the insert blocking any leakage that ruins the pizza box for recycling. For example, for a small 10"×10" pizza, the present invention would be slightly oversized by ¼"-¾ " to allow for the confinement edge to curl upward to confine the hot oils from escaping past the insert. The curled edges maintain that the pizza stays centered inside the box.

A single fold/or a double folded insert positions the pizza as a nesting pouch onto the non-porous insert. The pizza will not shift around and bump into the edges of the pizza box. Thus, making the entire pizza box fully recyclable.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A system for addition to a box for transporting food, the system comprising:

a) a top sheet of paper having a length and a width equal to a length and a width of an interior of the box, such that the top sheet fits within the interior of the box without being folded;

b) a bottom sheet of paper having a length and a width that are both at least half an inch longer than the length and the width of the interior of the box, such that when the bottom sheet is placed within the interior of the box, edges of the bottom sheet are configured to extend upwards along sides of the interior of the box;

c) the top sheet further including a fold at a top of the top sheet, the fold defining a strip of paper above the top sheet;

d) a first food-safe laminate coating on an interior surface of the top sheet, wherein said first coating has heat reflecting characteristics;

e) a second food-safe laminate coating on an interior surface of the bottom sheet, wherein said second coating has oil-resistant characteristics and heat reflecting characteristics;

f) a plurality of orifices in the top sheet, the plurality of orifices configured for allowing moisture to escape therethrough; and g) wherein the top and bottom sheets are configured for being removably positioned within the interior of the box, such that the food rests on the interior surface of the bottom sheet.

2. The system of claim 1, wherein the first food-safe laminate coating spans an entirety of the interior surface of the top sheet.

3. The system of claim 2, wherein the first food-safe laminate coating has non-stick characteristics.

4. The system of claim 3, wherein the second food-safe laminate coating spans an entirety of the interior surface of the bottom sheet.

5. The system of claim 4, wherein the second food-safe laminate coating has non-stick characteristics.

6. The system of claim 5, wherein the interior surface of the top sheet includes printed material configured for advertising.

7. The system of claim 6, wherein the interior surface of the bottom sheet includes printed material configured for advertising.

8. A system for transporting food, the system comprising:

a) a box having an interior including a length and width; and b) a set comprising:

1) a top sheet of paper having a length and a width equal to the length and width of the interior of the box, such that the top sheet fits within the interior of the box without being folded;

2) a bottom sheet of paper having a length and a width that are both at least half an inch longer than the length and the width of the interior of the box, such that when the bottom sheet is placed within the interior of the box, edges of the bottom sheet are configured to extend upwards along sides of the interior of the box;

3) a first food-safe laminate coating on an interior surface of the top sheet, wherein said first coating has heat reflecting characteristics;

4) a second food-safe laminate coating on an interior surface of the bottom sheet, wherein said second coating has oil-resistant and heat reflecting characteristics;

5) a plurality of orifices in the top sheet, the plurality of orifices configured for allowing moisture to escape therethrough; and 6) wherein the sheet is configured for being removably positioned within the interior of the box, such that the food rests on the interior surface of the bottom sheet.

9. The system of claim 8, wherein the first food-safe laminate coating spans an entirety of the interior surface of the top sheet.

10. The system of claim 9, wherein the first food-safe laminate coating has non-stick characteristics.

11. The system of claim 10, wherein the second food-safe laminate coating spans an entirety of the interior surface of the bottom sheet.

12. The system of claim 11, wherein the second food-safe laminate coating has non-stick characteristics.

13. The system of claim 12, wherein the interior surface of the top sheet includes printed material configured for advertising.

14. The system of claim 13, wherein the interior surface of the bottom sheet includes printed material configured for advertising.

15. The system of claim 14, wherein the bottom sheet includes a plurality of scoring elements, such that when the bottom sheet is placed within the interior of the box, the bottom sheet is configured to fold at the plurality of scoring elements, such that the edges of the bottom sheet extend upwards along sides of the interior of the box.

* * * * *